US009046828B2

(12) United States Patent
Yamane et al.

(10) Patent No.: US 9,046,828 B2
(45) Date of Patent: Jun. 2, 2015

(54) TRANSFER DEVICE AND IMAGE FORMING APPARATUS COMPRISING THE SAME

(71) Applicant: KYOCERA DOCUMENT SOLUTIONS INC., Osaka (JP)

(72) Inventors: Shinji Yamane, Osaka (JP); Yasuhiro Michishita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/956,594

(22) Filed: Aug. 1, 2013

(65) Prior Publication Data

US 2014/0037344 A1 Feb. 6, 2014

(30) Foreign Application Priority Data

Aug. 1, 2012 (JP) ..... 2012-170959

(51) Int. Cl.
*G03G 15/20* (2006.01)
*G03G 15/16* (2006.01)

(52) U.S. Cl.
CPC ..... *G03G 15/1665* (2013.01); *G03G 15/1675* (2013.01); *G03G 15/168* (2013.01)

(58) Field of Classification Search
CPC ..... G03G 2215/2022
USPC ..... 399/313, 303, 302, 164
See application file for complete search history.

(56) References Cited

U.S. PATENT DOCUMENTS

| | | | | |
|---|---|---|---|---|
| 6,188,862 | B1 * | 2/2001 | Ishii | 399/313 |
| 7,130,568 | B2 * | 10/2006 | Mochizuki | 399/298 |
| 7,460,811 | B2 * | 12/2008 | Mochizuki | 399/101 |
| 2006/0140687 | A1 * | 6/2006 | Furukawa | 399/313 |
| 2010/0239334 | A1 * | 9/2010 | Iwami et al. | 399/313 |

FOREIGN PATENT DOCUMENTS

| | | | |
|---|---|---|---|
| JP | H3-279137 | A | 12/1991 |
| JP | 09-034275 | A | 2/1997 |
| JP | H10-152242 | A | 6/1998 |
| JP | 2012-42650 | A | 3/2012 |

OTHER PUBLICATIONS

English Abstract and Translation for JP 09-034275, published Feb. 7, 1997.

(Continued)

*Primary Examiner* — Rodney Bonnette
(74) *Attorney, Agent, or Firm* — NDQ&M Watchstone LLP

(57) ABSTRACT

An image forming apparatus includes an image carrying member, a transport belt, a driving roller, a transferring member, a nip portion, and an applying portion. The transferring member makes contact with the inner circumferential surface of the transport belt to press the transport belt against the image carrying member. The nip portion is formed between the transport belt and the image carrying member by the pressure of the transferring member. The applying portion applies a bias to the transferring member. Application of the bias to the transferring member causes, at the nip portion, the toner image carried on the image carrying member to be transferred to the recording medium carried on the transport belt. Near the nip portion, a pair of support members are arranged which keeps both width-direction end parts of the transport belt in contact with the image carrying member.

14 Claims, 5 Drawing Sheets

(56) References Cited

OTHER PUBLICATIONS

English language Abstract and Machine Translation for JP-2012-42650 A, published Mar. 1, 2012.

English language Abstract for JP-H3-279137 A, published Dec. 10, 1991.

English language Abstract and Machine Translation for JP-H10-152242 A, published Jun. 9, 1998.

* cited by examiner

TRANSFER DEVICE AND IMAGE FORMING APPARATUS COMPRISING THE SAME

INCORPORATION BY REFERENCE

This application is based upon and claims the benefit of priority from the corresponding Japanese Patent Application No. 2012-170959 filed on Aug. 1, 2012, the entire contents of which are incorporated herein by reference.

BACKGROUND

The present disclosure relates to image forming apparatuses for use in copiers, printers, facsimile machines, multifunction products, that is, products having the functions of the just-mentioned devices integrated together, etc., and more particularly relates to image forming apparatuses in which a toner image on an image carrying member is transferred to a recording medium carried on a transport belt, or to an intermediary transfer belt.

There are conventionally known image forming apparatuses in which a recording medium carried on a transport belt is transported and, at a nip portion formed between the transport belt and an image carrying member, a toner image formed on the image carrying member is transferred to the recording medium. When the toner image on the image carrying member is transferred to the recording medium on the transport belt, a transferring member such as a transfer roller makes contact with the inner circumferential surface of the transport belt, and a voltage applied to the transferring member causes electric charge to be applied, via the transport belt, to the recording medium. This causes the toner image to be transferred to the recording medium.

Inconveniently, in the upstream-side vicinity of the nip portion with respect to the movement direction of the transport belt, a gap may be produced between the transport belt and the image carrying member. Then, immediately before the toner image on the image carrying member is transferred to the recording medium, electric discharge occurs between the transport belt and the image carrying member. This abnormal electric discharge disturbs the toner image on the image carrying member, resulting in poor image quality.

Thus, there are known related technologies for preventing abnormal electric discharge as mentioned above. For example, there is known an image forming apparatus in which a transport belt is deformed so as to make contact with and adhere closely to an image carrying member. In this image forming apparatus, on the upstream side of the nip portion, a plate-form lifting member is arranged. The lifting member lifts up the transport belt toward the image carrying member. This eliminates a gap in the upstream-side vicinity of the nip portion and thereby prevents abnormal electric discharge.

However, while abnormal electric discharge in a region near the nip portion before transfer is prevented, abnormal electric discharge also occurs in a width-direction end part of the transport belt. When a width-direction end part of the transport belt sags down between a driving roller and a following roller, the end part hangs down. This produces a gap, in an end part in the vicinity of the nip portion, between the transport belt and the image carrying member.

Also, the shafts of the driving roller and the following roller across which the transport belt is laid may be fitted with an inclination relative to each other. In that case, the transport belt moves with an inclination, and one width-direction end part of the transport belt makes contact with the image carrying member. An opposite end part, however, comes apart from the image carrying member, and a gap is produced between the transport belt and the image carrying member.

In this gap in the end part, from a transferring member to which a voltage is applied, electric charge is discharged to the image carrying member. Moreover, the electric charge accumulated on the transport belt is discharged to the image carrying member, and this may destroy the photosensitive layer on the image carrying member. The above-mentioned abnormal electric discharge in an end part of an image carrying member can occur also in an image forming apparatus in which a toner image formed on an image carrying member is transferred to an intermediary transfer belt.

Made with a view to overcoming the inconveniences discussed above, the present disclosure aims to provide an image forming apparatus that suppresses abnormal electric discharge in a width-direction end part of a transport belt or an intermediary transfer belt during transfer of a toner image formed on an image carrying member to a recording medium on the transport belt or to the intermediary transfer belt.

SUMMARY

According to one aspect of the present disclosure, an image forming apparatus includes an image carrying member, a transport belt, a driving roller, a transferring member, a nip portion, and an applying portion. The image carrying member carries a toner image. The transport belt is endless, and carries and transports, on the outer circumferential surface thereof, a recording medium to which the toner image on the image carrying member is transferred. The driving roller has the transport belt laid across it and a following roller, and rotates to drive the transport belt to move. The transferring member makes contact with the inner circumferential surface of the transport belt to press the transport belt against the image carrying member. The nip portion is formed between the transport belt and the image carrying member by the pressure of the transferring member. The applying portion applies a bias to the transferring member. Application of the bias to the transferring member causes, at the nip portion, the toner image carried on the image carrying member to be transferred to the recording medium carried on the transport belt. In the vicinity of the nip portion, a pair of support members is arranged which keeps both width-direction end parts of the transport belt in contact with the image carrying member.

According to another aspect of the present disclosure, an image forming apparatus includes an image carrying member, an intermediary transfer belt, a driving roller, a transferring member, a nip portion, and an applying portion. The image carrying member carries a toner image. The intermediary transfer belt is endless, and to its outer circumferential surface, which is arranged opposite the image carrying member, the toner image on the image carrying member is transferred. The driving roller has the intermediary transfer belt laid across it and a following roller, and rotates to drive the intermediary transfer belt to move. The transferring member makes contact with the inner circumferential surface of the intermediary transfer belt to press the intermediary transfer belt against the image carrying member. The nip portion is formed between the intermediary transfer belt and the image carrying member by the pressure of the transferring member. The applying portion applies a bias to the transferring member. Application of the bias to the transferring member causes, at the nip portion, the toner image carried on the image carrying member to be transferred to the intermediary transfer belt. In the vicinity of the nip portion, a pair of support members is arranged which keeps both width-direction end parts of the intermediary transfer belt in contact with the image carrying member.

Further features and advantages of the present disclosure will become apparent from the description of embodiments given below.

DETAILED DESCRIPTION

Hereinafter, embodiments of the present disclosure will be described with reference to the accompanying drawings. It should be understood that the present disclosure is in no way limited by the embodiments presented below. Nor is the present disclosure limited by the uses, terms, and other aspects specifically mentioned in the following description.

(First Embodiment)

Figure 1:
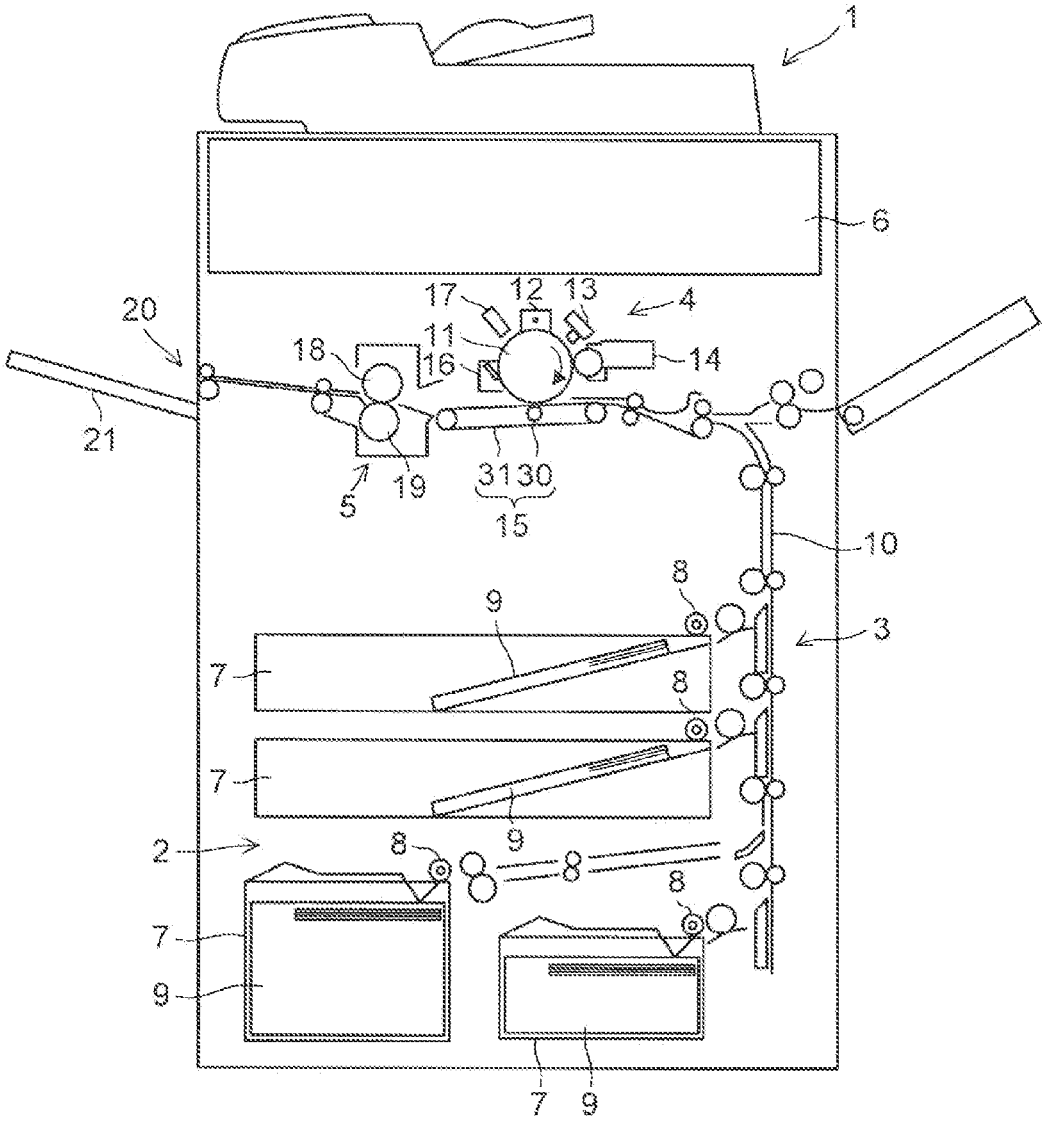
FIG. 1 is a diagram showing an outline of the structure of an image forming apparatus provided with a transfer section according to a first embodiment of the present disclosure.

FIG. 1 is a diagram showing an outline of the structure of an image forming apparatus provided with a transfer section according to one embodiment of the present disclosure. The image forming apparatus 1 is provided with a sheet feed section 2, a sheet transport section 3, an image formation section 4, a fusion section 5, and an image reading section 6. The sheet feed section 2 is arranged in a lower part of the image forming apparatus 1. The sheet transport section 3 is arranged to the side of the sheet feed section 2. The image formation section 4 is arranged over the sheet transport section 3. The fusion section 5 is arranged on the sheet-discharge side of the image formation section 4. The image reading section 6 is arranged over the image formation section 4 and the fusion section 5.

The sheet feed section 2 is provided with a plurality of sheet feed cassettes 7 which contain sheets 9 of a recording medium. As a sheet feed roller 8 rotates, from a selected one of the plurality of sheet feed cassettes 7, the sheets 9 are fed out, sheet by sheet, to the sheet transport section 3.

A sheet 9 fed to the sheet transport section 3 is transported through a sheet transport passage 10 toward the image formation section 4. The image formation section 4 forms a toner image on the sheet 9 by an electrophotography process. The image formation section 4 is provided with a photosensitive member 11, which rotates in the direction indicated by an arrow in FIG. 1, and the following components arranged around the photosensitive member 11 in its rotation direction: a charging section 12, an exposing section 13, a developing device 14, a transfer section 15, a cleaning section 16, and a anti-static section 17.

The charging section 12 is provided with a charging wire to which a high voltage is applied. When the surface of the photosensitive member 11 is given a predetermined potential by corona discharge from the charging wire, the surface of the photosensitive member 11 is electrically charged uniformly. When light based on the image data of a document read by the image reading section 6 is shone from the exposing section 13 onto the photosensitive member 11, the surface potential of the photosensitive member 11 is selectively attenuated. Thus, an electrostatic latent image is formed on the surface of the photosensitive member 11. Subsequently, the developing device 14 develops the electrostatic latent image on the surface of the photosensitive member 11, and thus a toner image is formed on the surface of the photosensitive member 11. The toner image carried on the photosensitive member 11 is then, when a bias is applied to a transfer roller 30 in the transfer section 15, transferred to the sheet 9 carried on a transport belt 31.

The sheet 9 having the toner image transferred to it is transported toward the fusion section 5 which is arranged on the downstream side of the transfer section 15 with respect to the sheet transport direction. In the fusion section 5, a heating member 18 and a pressing roller 19 heat and press the sheet 9, and thus the toner image is melted and fused onto the sheet 9. Subsequently, the sheet 9 having the toner image fused on it is discharged onto a discharge tray 21 by a pair of discharge rollers 20. After the transfer of the toner image to the sheet 9 by the transfer section 15, the toner remaining on the surface of the photosensitive member 11 is removed by the cleaning section 16. The electric charge remaining on the surface of the photosensitive member 11 is removed by the anti-static section 17. The photosensitive member 11 is then electrically charged again by the charging section 12, and thereafter image formation continues to be performed in a similar manner.

Figure 2:
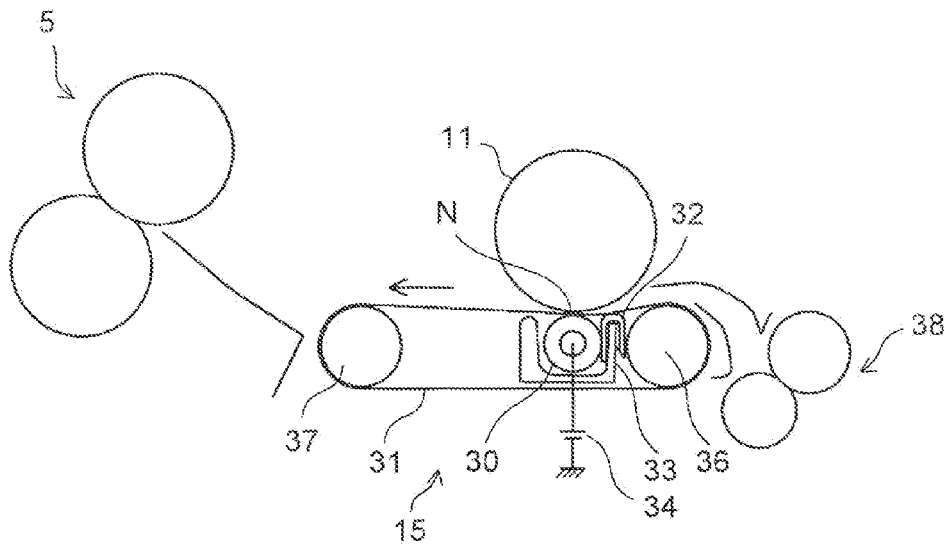
FIG. 2 is a side view showing an outline of the structure of the transfer section according to the first embodiment.

A detailed structure of the transfer section 15 is shown in FIG. 2. FIG. 2 is a side view showing an outline of the structure of the transfer section 15. The sheet 9 as a recording medium is transported from a pair of transport rollers 38 to the transfer section 15. Subsequently, the toner image carried on the photosensitive member 11 as an image carrying member is transferred to the sheet 9 by the transfer section 15, and then the sheet 9 is transported in the direction indicated by an arrow to undergo fusing by the fusion section 5.

The transfer section 15 is arranged under the photosensitive member 11. The transfer section 15 is provided with a transfer roller 30, a transport belt 31, a support member 32, a fitting member 33, a driving roller 36, a following roller 37, and a power supply 34. The transfer roller 30 is a transferring member. The transport belt 31 is an endless belt, and carries the sheet 9. The support member 32 lifts the transport belt 31 upward in the FIG. 2. The fitting member 33 holds the transfer roller 30 and the support member 32. The driving roller 36 and the following roller 37 have the transport belt 31 laid across them. The power supply 34 is an applying portion.

The transport belt 31 is configured as an endless belt formed by overlapping and joining together opposite end parts of a sheet-form material, or an endless belt having no seam. The transport belt 31 is laid across the driving roller 36 and the following roller 37 substantially in the horizontal direction. Moreover, the transport belt 31 is configured to have a charge property opposite to that of the toner of the toner image carried on the photosensitive member 11. Furthermore, the transport belt 31 is configured to have a comparatively high volume resistivity so that the sheet 9 is attracted onto the transport belt 31 by an electrostatic force appearing when a bias is applied to the transfer roller 30 as will be described later.

The driving roller 36 is arranged at the side of the pair of transport rollers 38, and is driven to rotate by a driving source such as an unillustrated motor. The following roller 37 is arranged at the side of the fusion section 5, in the horizontal direction relative to the driving roller 36, and is given substantially the same outer diameter as the driving roller 36. As the driving roller 36 is driven to rotate, the transport belt 31 laid across the driving roller 36 and the following roller 37 moves around. Thus, the sheet 9 attracted (carried) on the transport belt 31 is transported in the direction indicated by an arrow.

The transfer roller 30 is configured as a cylindrical core metal covered with electrically conductive rubber foam such as EPDM. Moreover, the transfer roller 30 has a lower volume resistivity than the transport belt 31. Furthermore, the transfer roller 30 is, at both end parts thereof in the length direction, rotatably held on the fitting member 33 on the inner circumferential surface side of the transport belt 31. Thus, the transfer roller 30 makes contact with the inner circumferential surface of the transport belt 31 and presses the outer circumferential surface of the transport belt 31 toward the photosensitive member 11. The pressure from the transfer roller 30 forms a nip portion N between the transport belt 31 and the photosensitive member 11.

The power supply 34 applies to the transfer roller 30 a predetermined voltage of the polarity reverse to the polarity of the toner attached on the photosensitive member 11. When the voltage is applied from the power supply 34 to the transfer roller 30, at the nip portion N, the toner on the photosensitive member 11 leaves the photosensitive member 11 and flies to the sheet 9 carried on the transport belt 31. Thus, the toner image on the photosensitive member 11 is transferred to the sheet 9. The sheet 9 having the toner image transferred to it is transported by the transport belt 31 toward the following roller 37. At this time, the resilience of the sheet 9 causes its leading edge to separate from the transport belt 31 against the curvature of the transport belt 31 which moves around the following roller 37, and thus the sheet 9 is transported to the fusion section 5.

In the transfer section 15 structured as described above, when the transport belt 31 is laid loose across the driving roller 36 and the following roller 37, the transport belt 31 sags down between the driving roller 36 and the following roller 37. Thus, even in the vicinity of the nip portion N, width-direction end parts of the transport belt 31 sag toward the transfer roller 30, producing a gap between the end parts of the transport belt 31 and end parts of the photosensitive member 11. When the shafts of the driving roller 36 and the following roller 37 and the shaft of the photosensitive member 11 are fitted with an inclination relative to each other with respect to the horizontal direction, the transport belt 31 laid across the driving roller 36 and the following roller 37 moves with an inclination relative to the horizontal direction with respect to the photosensitive member 11. When the transport belt 31 moves with an inclination, one width-direction end part of the transport belt 31 makes contact with the photosensitive member 11. On the other hand, the other end part may be apart from the photosensitive member 11. Thus, in the vicinity of the nip portion N, a gap is produced between an end part of the transport belt 31 and an end part of the photosensitive member 11. Moreover, when the shafts of the driving roller 36 and the following roller 37 are fitted with an inclination relative to each other, the transport belt 31 may move with an inclination relative to the horizontal direction. In that case, one width-direction end part of the transport belt 31 makes contact with the photosensitive member 11, but the other end part may be apart from the photosensitive member 11. Thus, in the vicinity of the nip portion N, a gap is produced between an end part of the transport belt 31 and an end part of the photosensitive member 11. In this gap in the end part, the electric charge accumulated on the transport belt 31 may be discharged to the photosensitive member 11, possibly destroying the photosensitive layer on the photosensitive member 11.

To prevent that, in this embodiment, in the vicinity of the nip portion N, a pair of support members 32 is provided which lifts up both width-direction end parts of the transport belt 31 to keep them in contact with the photosensitive member 11.

The support members 32 are formed by bending plate-form members into a U-shape so as to grip, in their part inside the U-shape, an upright wall portion of the fitting member 33. Thus, the support members 32 are fixed to and held on the fitting member 33 in the upstream-side vicinity of the nip portion N with respect to the movement direction of the transport belt 31. In this state, the support members 32, at their part bent in a U-shape, make contact with the inner circumferential surface of the transport belt 31 so as to lift up the transport belt 31. This permits the end parts of the transport belt 31 to make contact with the photosensitive member 11 in the upstream-side vicinity of the nip portion N. When the support members 32 lift up the transport belt 31, as shown in FIG. 2, the outer circumferential surface of the lifted parts of the transport belt 31 is out of contact with the photosensitive member 11. Instead of this structure, the support members 32 may be arranged closer to the nip portion N so that the outer circumferential surface of the lifted parts of the transport belt 31 makes contact with the photosensitive member 11 in the close vicinity of the nip portion N. Instead of the structure where the support members 32 lift up the inner circumferential surface of the transport belt 31 in the upstream-side vicinity of the nip portion N, a structure may be adopted where the support members 32 lift up the inner circumferential surface of the transport belt 31 in the downstream-side vicinity of the nip portion N. A structure may be adopted where the support members 32 are provided both in the upstream-side vicinity and in the downstream-side vicinity of the nip portion N.

The support members 32 are formed of an electrically insulating material, such as polycarbonate resin or ABS resin, that has a volume resistivity equal to or higher than that of the transfer roller 30. On the surface of the support members 32 at which they make contact with the transport belt 31, a sliding layer such as of high-polymer polyethylene resin is formed. The sliding layer permits the transport belt 31 to move smoothly in a state in contact with the support members 32.

Figure 3:
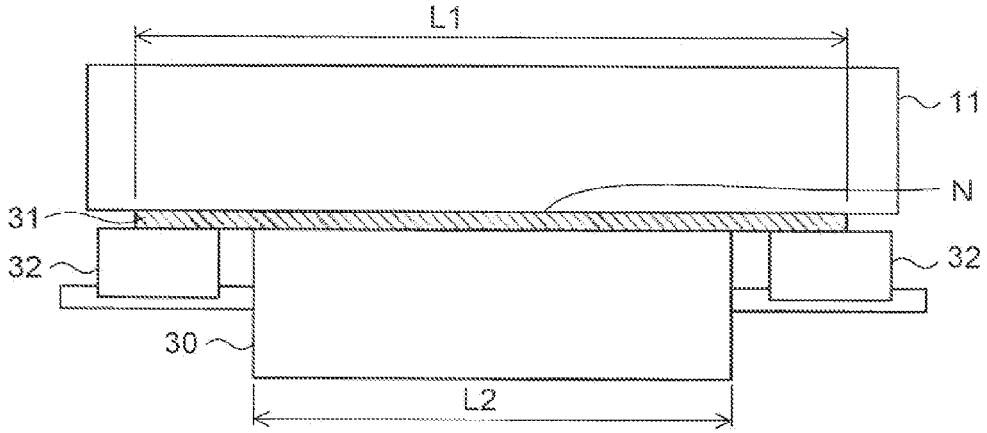
FIG. 3 is a plan view showing an outline of the structure of the transfer section according to the first embodiment.

The support members 32 are configured, in the width direction of the transport belt 31 (in the length direction of the transfer roller 30), as shown in FIG. 3. FIG. 3 is a plan view schematically showing the arrangement configuration of the transfer roller 30, the transport belt 31, and the support members 32 in the vicinity of the nip portion N.

The photosensitive member 11 is formed elongate in the length direction. The transport belt 31 is formed to have a smaller width-direction dimension than the photosensitive member 11, and makes contact with the photosensitive member 11 over a contact width L1. The transport belt 31 makes contact with the transfer roller 30 over a contact width L2, and the contact widths L1 and L2 are configured to fulfill the relationship L1>L2.

The support members 32 are arranged at both width-direction end parts of the transport belt 31. Of each support member 32, one end part is arranged at a position a predetermined distance away from an end face of the transfer roller 30, and the other end part is arranged at a position protruding from an end part of the transport belt 31. Thus, outside the transfer region of the transfer roller 30, the support members 32 make contact with the inner circumferential surface of the transport belt 31 up to its end parts, and lift up both width-direction end parts of the transport belt 31.

In the structure described above, when a voltage is applied to the transfer roller 30, the transport belt 31 is electrically charged, and a sheet 9 in a state attracted on the transport belt 31 is transported to the nip portion N. At the nip portion N, as a result of the application of the voltage to the transfer roller 30, the toner image formed on the photosensitive member 11 is transferred to the sheet 9 on the transport belt 31. Here, both width-direction end parts of the transport belt 31 are lifted up by the support members 32. Thus, even when the transport belt 31 is loose, or when the transport belt 31 is inclined or otherwise displaced relative to the photosensitive member 11, the width-direction end parts of the transport belt 31 are lifted up to make contact with the photosensitive member 11. Thus, no gap is produced between the transport belt 31 and the photosensitive member 11. This prevents destruction of the photosensitive layer on the photosensitive member 11 resulting from abnormal electric discharge between the transport belt 31 and the photosensitive member 11.

Moreover, in this embodiment, the support members 32 are arranged on the upstream side of the nip portion N with respect to the movement direction of the transport belt 31. With this structure, before the toner image formed on the photosensitive member 11 is transferred to the sheet 9 on the transport belt 31, abnormal electric discharge between the transport belt 31 and the photosensitive member 11 at their end parts is prevented. Thus, the toner image on the photosensitive member 11 is not disturbed by abnormal electric discharge, and a satisfactory toner image is transferred to the sheet 9.

Moreover, in this embodiment, the contact width L1 between the transport belt 31 and the photosensitive member 11 and the contact width L2 between the transport belt 31 and the transfer roller 30 fulfills the relationship L1>L2. That is, the contact width L1 of the transport belt 31 with the photosensitive member 11 is configured to be larger than the contact width L2 with the transfer roller 30. With this structure, the electric charge that would otherwise be discharged from the end parts of the transfer roller 30 to the photosensitive member 11 is blocked by the transport belt 31. This eliminates electric discharge from the end parts of the transfer roller 30 to the photosensitive member 11, and prevents destruction of the photosensitive layer on the photosensitive member 11.

Moreover, in this embodiment, the support members 32 are formed of an electrically insulating material, and their volume resistivity is equal to or higher than that of the transfer roller 30. Generally, from a cause such as the driving roller 36 and the following roller 37 being inclined to each other, the transport belt 31 laid across the driving roller 36 and the following roller 37 may meander in the length direction. When the transport belt 31 meanders, at a length-direction end part thereof, there may occur a place where the transport belt 31 is absent between the transfer roller 30 and the photosensitive member 11. At the place where the transport belt 31 is absent, electric discharge occurs from an end part of the transfer roller 30 to the photosensitive member 11, and destroys the photosensitive layer on the photosensitive member 11. With the structure described above, however, the support members 32 of an electrically insulating material block the electric charge that would otherwise be discharged from the end part of the transfer roller 30 to the photosensitive member 11, and thus the photosensitive layer on the photosensitive member 11 is prevented from being destroyed.

Moreover, in this embodiment, the support members 32 are configured to be formed by bending plate-form members into a U-shape, and can be fitted to the fitting member 33 easily without requiring a large space.

(Second Embodiment)

Figure 4:
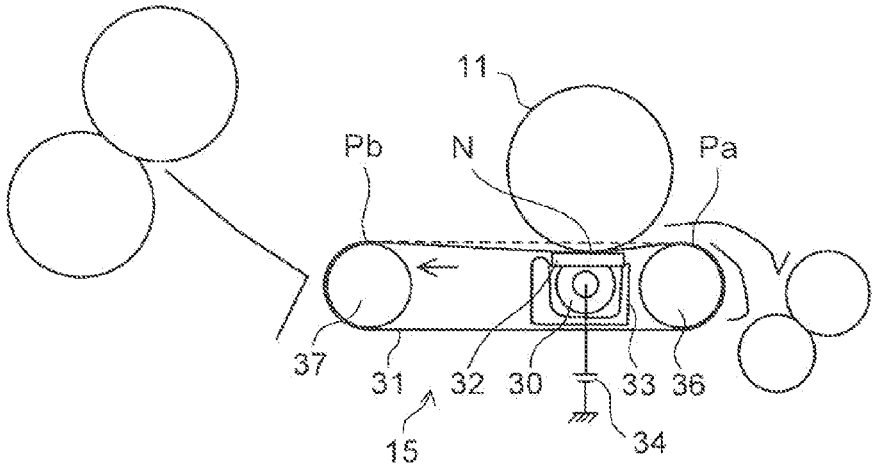
FIG. 4 is a side view showing an outline of the structure of a transfer section according to a second embodiment of the present disclosure.
Figure 5:
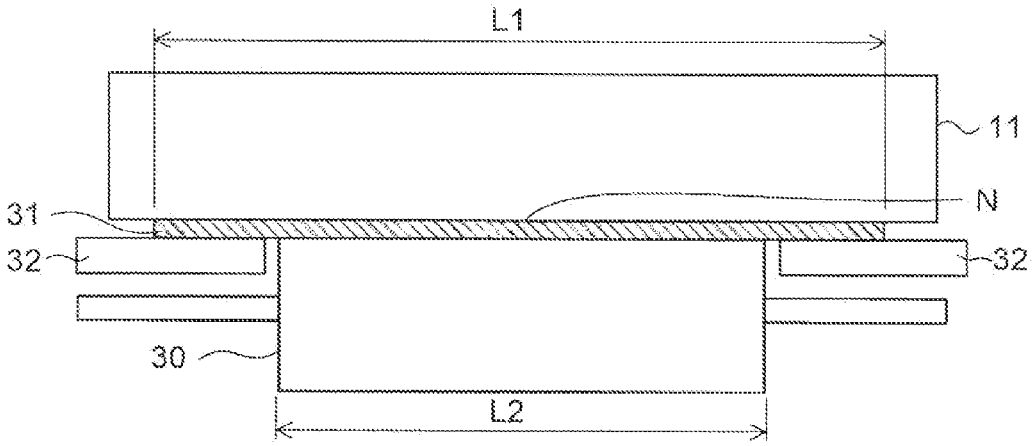
FIG. 5 is a plan view showing an outline of the structure of the transfer section according to the second embodiment.

FIGS. 4 and 5 show the structure of the transfer section 15 in a second embodiment of the present disclosure. FIG. 4 is a side view showing an outline of the structure of the transfer section 15. FIG. 5 is a plan view schematically showing the arrangement configuration of the transfer roller 30, the transport belt 31, and the support members 32 at the nip portion N. In the second embodiment, the support members 32 are configured differently than in the first embodiment. Accordingly, the following description mainly discusses the support members 32 that are different from those in the first embodiment, and no description of the same features as in the first embodiment will be repeated.

As shown in FIG. 4, the support members 32 are plate-formed, and are fixed to and held on the top face side of the fitting member 33. Moreover, the support members 32 are arranged at a position overlapping the nip portion N with respect to the movement direction of the transport belt 31, and are arranged outside both end parts of the nip portion N in the width direction of the transport belt 31 (see FIG. 5 also). In this state, the support members 32, with their flat surface, make contact with the inner circumferential surface of the transport belt 31 and lift up the transport belt 31, while the end parts of the transport belt 31 make contact with the photosensitive member 11 in the close vicinity of the nip portion N.

The support members 32 are formed of a material, such as polyurethane sponge, that is elastic and in addition electrically insulating, with a volume resistivity equal to or higher than that of the transfer roller 30. On the surface of the support members 32 at which they make contact with the transport belt 31, a sliding layer of for example, high-polymer polyethylene resin is formed. The sliding layer permits the transport belt 31 to move smoothly in a state in contact with the support members 32.

The transfer roller 30 is pressed against the photosensitive member 11 across the transport belt 31. In this pressed state, the transport belt 31 has a concave sag toward the transfer roller 30 with respect to the tangent line (indicated by a broken line in FIG. 4) connecting between the intersection Pa with the outer circumference of the driving roller 36 and the intersection Pb with the outer circumference of the following roller 37 in the direction in which the transport belt 31 is laid (in the horizontal direction).

As shown in FIG. 5, the photosensitive member 11 is formed elongate in the length direction. The transport belt 31 is formed shorter than the photosensitive member 11 in the length direction, and makes contact with the photosensitive member 11 over a contact width L1. The transport belt 31 makes contact with the transfer roller 30 over a contact width L2, and the contact widths L1 and L2 are so configured as to fulfill the relationship L1>L2.

The support members 32 are arranged at both width-direction end parts of the transport belt 31. Of each support member 32, one end part is arranged at a position a predetermined distance away from an end face of the transfer roller 30, and the other end part is arranged at a position protruding from a width-direction end part of the transport belt 31. Thus, outside the transfer region of the transfer roller 30, the support members 32 make contact with the inner circumferential surface of the transport belt 31 up to its end parts, and lift up both width-direction end parts of the transport belt 31.

In the structure described above, when a voltage is applied to the transfer roller 30, the transport belt 31 is electrically charged, and a sheet 9 in a state attracted on the transport belt 31 is transported to the nip portion N. At the nip portion N, as a result of the application of the voltage to the transfer roller 30, the toner image formed on the photosensitive member 11 is transferred to the sheet 9 on the transport belt 31. Here, both end parts of the transport belt 31 are lifted up by the support members 32. Thus, even when the transport belt 31 is loose, or when the transport belt 31 is inclined or otherwise displaced relative to the photosensitive member 11, the outer circumferential surface of the transport belt 31 makes contact with the photosensitive member 11. Thus, no gap is produced between the width-direction end parts of the transport belt 31 and the photosensitive member 11. This prevents destruction of the photosensitive layer on the photosensitive member 11 resulting from abnormal electric discharge between the transport belt 31 and the photosensitive member 11.

Moreover, in this embodiment, the contact width L1 between the transport belt 31 and the photosensitive member 11 and the contact width L2 between the transport belt 31 and the transfer roller 30 fulfills the relationship L1>L2. That is, the contact width L1 of the transport belt 31 with the photosensitive member 11 is configured to be larger than the contact width L2 with the transfer roller 30. With this structure, the electric charge that would otherwise be discharged from the end parts of the transfer roller 30 to the photosensitive member 11 is blocked by the transport belt 31. This eliminates electric discharge from the end parts of the transfer roller 30 to the photosensitive member 11, and prevents destruction of the photosensitive layer on the photosensitive member 11.

Moreover, in this embodiment, the support members 32 are formed of an electrically insulating material, and their volume resistivity is equal to or higher than that of the transfer roller 30. Generally, from a cause such as the driving roller 36 and the following roller 37 being inclined to each other, the transport belt 31 laid across the driving roller 36 and the following roller 37 may meander in the length direction. When the transport belt 31 meanders, at a length-direction end part thereof, there may occur a place where the transport belt 31 is absent between the transfer roller 30 and the photosensitive member 11. At the place where the transport belt 31 is absent, electric discharge occurs from an end part of the transfer roller 30 to the photosensitive member 11, and destroys the photosensitive layer on the photosensitive member 11. With the structure described above, however, the support members 32 of an electrically insulating material block the electric charge that would otherwise be discharged from the end part of the transfer roller 30 to the photosensitive member 11, and thus the photosensitive layer on the photosensitive member 11 is prevented from being destroyed.

Moreover, in this embodiment, the transport belt 31 is configured to have a concave sag toward the transfer roller 30 with respect to the tangent line connecting between the intersection Pa with the outer circumference of the driving roller 36 and the intersection Pb with the outer circumference of the following roller 37. With this structure, when the support members 32 lift up the end parts of the transport belt 31, in the vicinity of the nip portion N, the outer circumferential surface of the transport belt 31 at its end parts makes contact with the photosensitive member 11 more reliably. Thus, no gap is likely to be produced between the transport belt 31 and the photosensitive member 11. This more reliably prevents destruction of the photosensitive layer on the photosensitive member 11 resulting from abnormal electric discharge between the transport belt 31 and the photosensitive member 11.

Moreover, in this embodiment, the support members 32 are configured to be plate-formed, and can be fitted to the fitting member 33 easily without requiring a large space.

Although, in the first and second embodiments described above, the transferring member is configured as a transfer roller 30, this is not meant to limit the present disclosure; a blade-form transferring member may instead be used. Also in that case, the same effect can be obtained as with the embodiments described above.

(Third Embodiment)

Figure 6:
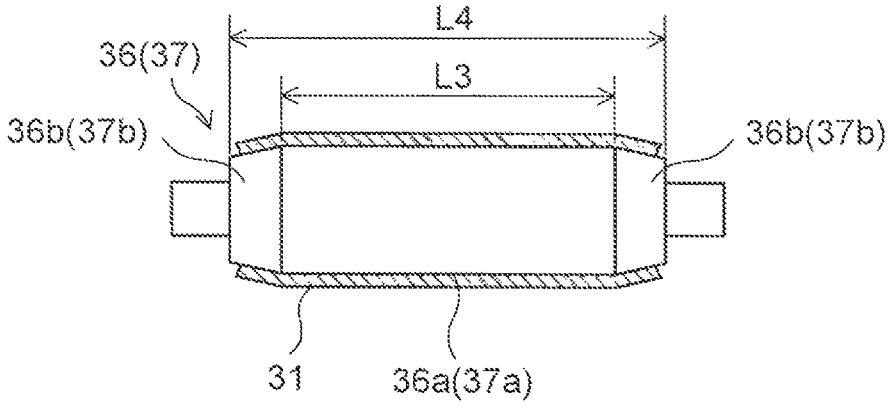
FIG. 6 is a plan view showing the structure of a driving roller according to a third embodiment of the present disclosure.

FIG. 6 is a plan view showing the structure of the driving roller 36 and the following roller 37 in a third embodiment of the present disclosure. In the third embodiment, the meandering of the transport belt 31 resulting from an inclination in the shafts of the driving roller 36 and the following roller 37 is restricted. The transfer section 15 including the transfer roller 30, the support members 32, etc. is structured as in the first or second embodiment. The driving roller 36 and the following roller 37 have the same structure, and therefore the following description discusses the driving roller 36.

The driving roller 36 has a belt holding portion 36*a* and truncated conical portions 36*b*. The belt holding portion 36*a* is cylindrical in shape, and holds the transport belt 31 so as to cause, along with the following roller 37, the transport belt 31 to be rotatably laid across them. The truncated conical portions 36*b* are provided contiguously at both length-direction end parts of the belt holding portion 36*a*, and are so formed as to have an increasingly small diameter toward the ends. The truncated conical portions 36*b* restrict the meandering of the transport belt 31 in the width direction by making contact with the end parts of the transport belt 31.

Owing to the meandering of the transport belt 31 in the width direction being restricted, the transport belt 31 remains present between the transfer roller 30 and the photosensitive member 11 all the time, and the transfer roller 30 and the photosensitive member 11 do not face each other. Thus, no electric discharge occurs from the end part of the transfer roller 30 to the photosensitive member 11, and the photosensitive layer of the photosensitive member 11 is prevented from destruction.

Moreover, the extension factor of the transport belt 31 is set to be equal to or higher than the belt contraction factor at the truncated conical portions 36*b* (37*b*) of the driving roller 36 and the following roller 37 with respect to the belt holding portion 36*a* (37*a*). Thus, the end parts of the transport belt 31 make contact with the truncated conical portions 36*b*, and, when the driving roller 36 is in a grounded state, the electric charge remaining on the transport belt 31 is removed via the truncated conical portions 36*b*. Thus, the next session of transfer can be performed stably.

The belt holding portion 36*a* has a length L3 in the length direction, while the roller portion of the driving roller 36 has a total length of L4. That is, a structure is adopted where, let the contact width between the transfer roller 30 and the transport belt 31 be L2 (see FIGS. 3 and 5), then the relationship L3>L2 is fulfilled. That is, the length of the belt holding portion 36*a* in the length direction is configured to be greater than the contact width L2 between the transport belt 31 and the transfer roller 30.

With this structure, at the part of the transport belt 31 in contact with the driving roller 36, the end parts of the transport belt 31 are deformed to fit the truncated conical portion 36*b*. In the vicinity of the nip portion N, however, the end parts of the transport belt 31 are lifted up by the support members 32. Thus, in the vicinity of the nip portion N, the end parts of the transport belt 31 make contact with the photosensitive member 11, so that no gap is produced between the end parts of the transport belt 31 and the photosensitive member 11. This prevents destruction of the photosensitive layer on the photosensitive member 11 resulting from abnormal electric discharge between the transport belt 31 and the photosensitive member 11. Moreover, owing to the meandering of the transport belt 31 being restricted, no electric discharge occurs from the end parts of the transfer roller 30 to the photosensitive member 11. Thus, the photosensitive layer on the photosensitive member 11 is prevented from destruction.

In the third embodiment described above, a structure may be adopted where, in the vicinity of the nip portion N, the transport belt 31 is arranged so as to have a concave sag toward the transfer roller 30 (as in FIG. 4) so that the support members 32 lift up the end parts of the transport belt 31. That is, a structure may be adopted where there is a concave sag toward the transfer roller 30 with respect to the tangent line connecting between the intersections Pa and Pb with the smaller-diameter portions (outer circumferential portion) of the truncated conical portions 36*b* in the driving roller 36 and the following roller 37. In this state, when the support members 32 lift up the end parts of the transport belt 31, the end parts of the transport belt 31 make contact with the photosensitive member 11 more reliably.

Moreover, in the third embodiment described above, a structure may be adopted where the truncated conical portions 36*b* (37*b*) are formed in one of the driving roller 36 and the following roller 37, or a structure may be adopted where the truncated conical portions 36*b* (37*b*) are formed in both of the driving roller 36 and the following roller 37.

(Fourth Embodiment)

Figure 7:
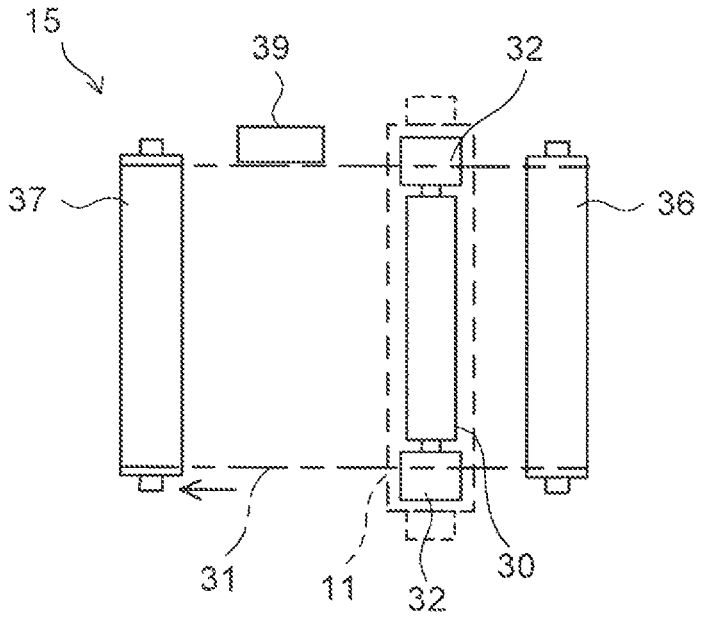
FIG. 7 is a plan view showing the structure of a transfer section provided with a meandering restricting member according to a fourth embodiment of the present disclosure.

FIG. 7 is a plan view showing the structure of the transfer section provided with a meandering restricting member according to a fourth embodiment of the present disclosure, being a view of the transfer section shown in FIG. 4 as seen from above. In the fourth embodiment, as in the third embodiment, the meandering of the transport belt 31 due to an inclination in the shafts of the driving roller 36 and the following roller 37 is restricted, and a meandering restricting member 39 is provided.

The meandering restricting member 39 is fixed to the body of the apparatus, and makes contact with one width-direction end face of the transport belt 31. The driving roller 36 and the following roller 37 are arranged with their shafts so inclined that the transport belt 31 moves (meander), in the width direction, toward the meandering restricting member 39. Accordingly, as the transport belt 31 moves around, one end face of the transport belt 31 remains in contact with the meandering restricting member 39 all the time, and thereby meandering in the width direction is restricted.

Owing to the meandering of the transport belt 31 being restricted, the transport belt 31 remains present between the transfer roller 30 and the photosensitive member 11 all the time, and the transfer roller 30 and the photosensitive member 11 do not face each other. Thus, no electric discharge occurs from the end part of the transfer roller 30 to the photosensitive member 11, and the photosensitive layer of the photosensitive member 11 is prevented from destruction.

(Fifth Embodiment)

Figure 8:
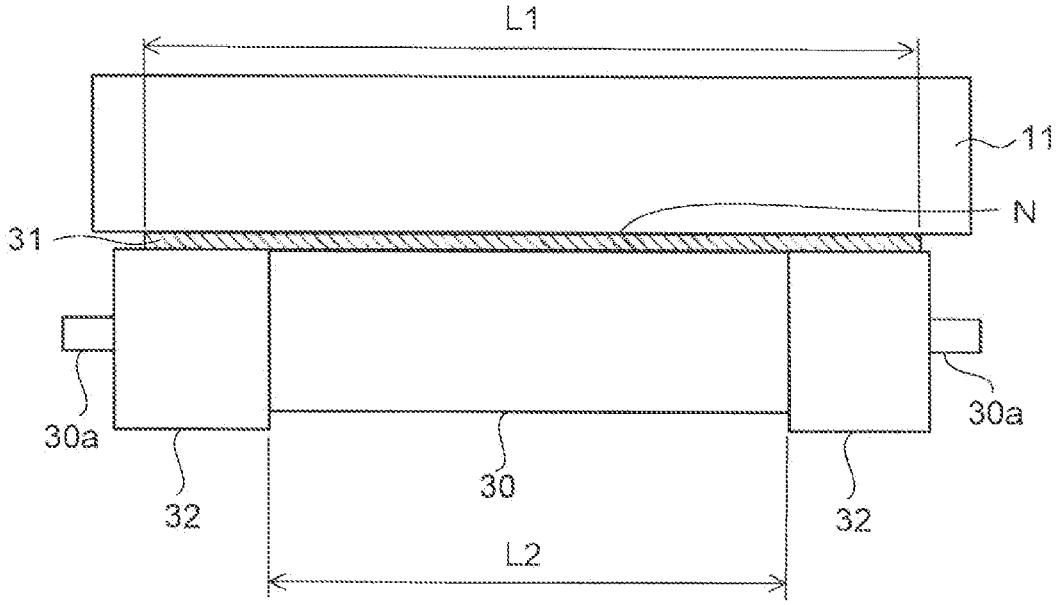
FIG. 8 is a plan view showing an outline of the structure of a transfer section according to a fifth embodiment of the present disclosure.

FIG. 8 is a plan view schematically showing the arrangement configuration of the transfer roller 30, the transport belt 31, and the support members 32 at the nip portion N in a fifth embodiment of the present disclosure. In the fifth embodiment, the support members 32 are configured as rollers.

The support members 32 are fitted around the core metal 30*a* which extends from both end parts of the transfer roller 30, and are fixed, in a state in contact with the end faces of the transfer roller 30, to the transfer roller 30 with electrically non-conductive adhesive. As the transfer roller 30 rotates, the support members 32 rotate, and in addition make contact with the inner circumferential surface of the transport belt 31 so as to lift up the transport belt 31.

With the structure described above, even when the transport belt 31 is loose, or when the transport belt 31 is inclined or otherwise displaced relative to the photosensitive member 11, the end parts of the transport belt 31 are lifted up by the support members 32. Thus, the outer circumferential surface of the transport belt 31 makes contact with the photosensitive member 11, and no gap is produced between the end parts of the transport belt 31 and the photosensitive member 11. This prevents destruction of the photosensitive layer on the photosensitive member 11 resulting from abnormal electric discharge between the transport belt 31 and the photosensitive member 11.

Moreover, since the support members 32 are configured as rollers which are rotatable, while the transport belt 31 moves around, the friction at the contact between the roller surface of the support members 32 and the inner circumferential surface of the transport belt 31 is reduced. This prevents wear in the transport belt 31.

The support members 32 have an outer diameter greater than that of the transfer roller 30, and in addition are formed of electrically insulating rubber foam having a hardness lower than that of the transfer roller 30. With this structure, the support members 32, by elastically deforming, remain in close contact with the transport belt 31. This prevents abnormal electric discharge from the transfer roller 30. Moreover, in a case where the support members 32 are formed of electrically insulating rubber having a hardness higher than that of the transfer roller 30, when the support members 32 are given the same outer diameter as the transfer roller 30, the support members 32 make contact with the transport belt 31, and abnormal electric discharge from the transfer roller 30 is prevented.

When the transport belt 31 meanders, at a width-direction end part thereof, there may occur a place where the transport belt 31 is absent between the transfer roller 30 and the photosensitive member 11. At the place where the transport belt 31 is absent, electric discharge occurs from the end part of the transfer roller 30 to the photosensitive member 11, and the photosensitive layer on the photosensitive member 11 is destroyed. With the structure described above, however, the support members 32, which are electrically insulating, block the electric charge that would otherwise be discharged from the end part of the transfer roller 30 to the photosensitive member 11, and thus the photosensitive layer on the photosensitive member 11 is prevented from destruction.

The photosensitive member 11 is formed elongate in the length direction. The transport belt 31 is formed to have a smaller width-direction dimension than the photosensitive member 11, and makes contact with the photosensitive member 11 over a contact width L1. The transport belt 31 makes contact with the transfer roller 30 over a contact width L2, and the contact widths L1 and L2 are so configured as to fulfill the relationship L1>L2. With this structure, the electric charge that would otherwise be discharged from the end part of the transfer roller 30 to the photosensitive member 11 is blocked by the transport belt 31. Thus, no electric discharge occurs from the end part of the transfer roller 30 to the photosensitive member 11, and the photosensitive layer on the photosensitive member 11 is prevented from destruction.

The fifth embodiment described above deals with an example where the support members 32 are coaxial with the transfer roller 30 and are, in a state in contact with the end faces of the transfer roller 30, fixed to the transfer roller 30. This, however, is not meant to limit the present disclosure. The support members 32 may be provided away from the end faces of the transfer roller 30, and may be configured as rollers that are separately provided on a rotary shaft separate from the core metal 30*a* of the transfer roller 30.

Moreover, in the fifth embodiment described above, a structure may be adopted where meandering is restricted by providing one of the driving roller 36 and the following roller 37 having the truncated conical portions 36*b* and 37*b* formed therein as shown in FIG. 6. In that case, when a structure is adopted where the belt holding portion 36*a* has a length L3 (see FIG. 6) in the length direction and, let the contact width of the transfer roller 30 in the length direction with the transport belt 31 be L2 (see FIGS. 3 and 5), the relationship L3>L2 is fulfilled, the same effect can be obtained as with the embodiments described above.

Moreover, in the fifth embodiment described above, a structure may be adopted where, for meandering restriction, a meandering restricting member 39 (see FIG. 7) that makes contact with a side face of the transport belt 31 is provided. Furthermore, in the fifth embodiment, a structure (see FIG. 4) may be adopted where the transport belt 31 is arranged with a concave sag toward the transfer roller 30 with respect to the tangent line connecting between the intersection Pa with the driving roller 36 and the intersection Pb with the following roller 37.

Although the first to fifth embodiments described above deal with examples of application to an image forming apparatus 1 that transfers to a sheet 9 carried on a transport belt 31, this is not meant to limit the present disclosure; application is also possible to an image forming apparatus 1 in which, by application of a bias to a transfer roller 30, a toner image carried on a photosensitive member 11 is, at a nip portion N, transferred to an intermediary transfer belt. Also in that case, the same effect is obtained as with the embodiments described above.

EXAMPLES

Hereinafter, practical examples that more specifically embody the present disclosure will be presented in contrast to a comparative example. The present disclosure is not limited to the examples presented below.

All of the practical and comparative examples deal with an image forming apparatus 1 configured as follows. The photosensitive member 11 is formed of an amorphous silicon photosensitive material, has an outer diameter of 40 mm, and has a length-direction dimension of 360 mm. The transport belt 31 has, when formed into a circle, an inner diameter of 50 mm, and has a width-direction dimension of 320 mm. The transfer roller 30 is formed of electrically conductive EPDM foam, has a hardness of 60 degrees on the AskerC scale, has an outer diameter of 14 mm, and a length-direction dimension of 310 mm. The contact width L1 between the transport belt 31 and the photosensitive member 11 is 320 mm, and the contact width L2 between the transport belt 31 and the transfer roller 30 is 310 mm.

In Example 1, the photosensitive member 11, the transfer roller 30, and the transport belt 31 structured as described above were used. The support members 32 were configured to have the shape and material as in the first embodiment described previously, the dimension of the support members 32 in the length direction of the transfer roller 30 was 5 mm, and the support members 32 were arranged 2 mm away from the end faces of the transfer roller 30. As for the driving roller 36 and the following roller 37, the total length L4 of the roller portion was 317 mm, the outer diameter of the belt holding portions 36*a* and 37*a* was 20 mm, the length-direction length L3 of the belt holding portions 36*a* and 37*a* was 312 mm, and the outer diameter of the smaller-diameter portions of the truncated conical portions 36*h* and 37*b* was 19 mm.

With this structure, after a 300K-sheet printing endurance test, the photosensitive layer on the photosensitive member 11 was inspected visually, and no destruction of the photosensitive layer was observed. Even with the length of the nip portion N set at 3 mm in the movement direction of the transport belt 31, no destruction of the photosensitive layer was observed, and satisfactory results were obtained.

In Example 2, the photosensitive member 11, the transfer roller 30, and the transport belt 31 as described above were used. The support members 32 were configured to have the shape and material as in the second embodiment described previously, the dimension of the support members 32 in the length direction of the transfer roller 30 was 8 mm, and the support members 32 were arranged 1 mm away from the end faces of the transfer roller 30. As for the driving roller 36 and the following roller 37, the total length L4 of the roller portion was 317 mm, the outer diameter of the belt holding portions 36*a* and 37*a* was 20 Him, the length-direction length L3 of the belt holding portions 36*a* and 37*a* was 312 mm, and the outer diameter of the smaller-diameter portions of the truncated conical portions 36*b* and 37*b* was 19 mm.

With this structure, after a 300K-sheet printing endurance test, the photosensitive layer on the photosensitive member 11 was inspected visually, and no destruction of the photosensitive layer was observed. Even with the length of the nip portion N set at 3 mm in the movement direction of the transport belt 31, no destruction of the photosensitive layer was observed, and satisfactory results were obtained.

On the other hand, in Comparative Example 1, the photosensitive member 11, the transfer roller 30, and the transport belt 31 structured as described above were used, but no support members 32 were provided. As for the driving roller 36 and the following roller 37, the total length L4 of the roller portion was 317 mm, the outer diameter of the belt holding portions 36*a* and 37*a* was 20 mm, the length-direction length L3 of the belt holding portions 36*a* and 37*a* was 305 mm, and the outer diameter of the smaller-diameter portions of the truncated conical portions 36*b* and 37*b* was 19 mm.

With this structure, in the vicinity of the nip portion N, the end parts of the transport belt 31 came apart from the photosensitive member 11, and after a 50K-sheet printing endurance test, at the end parts of the photosensitive member 11, the photosensitive layer was destroyed by electric discharge.

Next, the roller-form support members 32 (the support members 32 in the fifth embodiment) were tested in combination with the photosensitive member 11, the transfer roller 30, and the transport belt 31 configured as in first embodiment. As the driving roller 36 and the following roller 37, cylindrical rollers having no truncated conical portions like 36*b* and 37*b* formed in them were used. The support members 32 were, in a state in contact with the end faces of the transfer roller 30, fixed to the transfer roller 30 with electrically non-conductive adhesive.

The configuration of the support members 32 in Examples 3 to 6 and the evaluation results of those examples are listed in Table 1.

TABLE 1

| Configuration of the Support Members 32 | | | | | |
|---|---|---|---|---|---|
| | Width (mm) | Outer Diameter (mm) | Material | Leakage | Image Quality |
| Example 3 | 3 | 16 | Insulating EPDM foam, 50° AskerC | No | Good |
| Example 4 | 8 | 14 | Insulating EPDM foam, 50° AskerC | No | Good |
| Example 5 | 8 | 16 | Insulating EPDM foam, 50° AskerC | No | Good |
| Example 6 | 8 | 14 | Insulating EPDM Solid, 65° JisA | No | Good |

With the shafts of the driving roller 36 and the following roller 37 inclined relative to each other so that the transport belt 31 tends to meander, 5,000 sheets of A4Y paper were printed, and abnormal electric discharge (leakage) and image quality after transfer were evaluated.

In Example 3, the dimension of the support members 32 in the length direction of the transfer roller 30 was comparatively small, but elastic deformation of the EPDM foam of which the support members 32 were formed kept them in close contact with the transport belt 31. No abnormal electric discharge occurred, and image quality was satisfactory. In Example 4, the dimension of the support members 32 in the length direction of the transfer roller 30 was comparatively large, the outer diameter of the support members 32 was the same as that of the transfer roller 30, and the support members 32 and the transport belt 31 were in contact with each other. No abnormal electric discharge occurred, and image quality was satisfactory. In Example 5, the dimension of the support members 32 in the length direction of the transfer roller 30 was comparatively large, and elastic deformation of the EPDM foam of which the support members 32 were formed kept them in close contact with the transport belt 31. No abnormal electric discharge occurred, and image quality was satisfactory. In Example 6, the dimension of the support members 32 in the length direction of the transfer roller 30 was comparatively large, the outer diameter of the support members 32 was the same as that of the transfer roller 30, and the support member 32 and the transport belt 31 were in contact with each other. No abnormal electric discharge occurred, and image quality was satisfactory.

The present disclosure finds applications in image forming apparatuses for use in copiers, printers, facsimile machines, multifunction products, that is, products having the functions of the just-mentioned devices integrated together, etc., in particular in image forming apparatuses in which a toner image on an image carrying member is transferred to a recording medium carried on a transport belt, or to an intermediary transfer belt.

What is claimed is:

1. An image forming apparatus comprising:

an image carrying member on which a toner image is carried;

an endless transport belt which carries and transports, on an outer circumferential surface thereof, a recording medium to which the toner image on the image carrying member is transferred;

a driving roller across which and a following roller the transport belt is laid, the driving roller rotating to drive the transport belt to move;

a transferring member which makes contact with an inner circumferential surface of the transport belt to press the transport belt against the image carrying member;

a nip portion formed between the transport belt and the image carrying member by a pressure of the transferring member; and an applying portion for applying a bias to the transferring member, application of the bias to the transferring member causing, at the nip portion, the toner image carried on the image carrying member to be transferred to the recording medium carried on the transport belt, wherein the image forming apparatus further comprises, in a vicinity of the nip portion, a pair of support members which keeps both width-direction end parts of the transport belt in contact with the image carrying member, and the support members are respectively fixed to fitting members that respectively hold both end parts of the transferring member, the support members respectively protruding, at one end thereof, from both end parts of the transfer belt in a width direction thereof.

2. The image forming apparatus according to claim 1, wherein the support members are, in a vicinity of the nip portion, fixed to a body of the apparatus so as to make contact with the inner circumferential surface of the transport belt in the width-direction end parts thereof.

3. The image forming apparatus according to claim 2, wherein the support members are arranged on an upstream side of the nip portion with respect to a movement direction of the transport belt.

4. The image forming apparatus according to claim 2, wherein the support members are arranged at a position overlapping the nip portion with respect to a movement direction of the transport belt, outside both ends of the nip portion in the width direction of the transport belt.

5. The image forming apparatus according to claim 2, wherein the support members are formed of an electrically insulating material, and have a volume resistivity equal to or higher than a volume resistivity of the transferring member.

6. The image forming apparatus according to claim 2, wherein the support members are formed in a shape of plates.

7. The image forming apparatus according to claim 1, wherein the transferring member comprises a rotatably supported roller; and the support members comprise rotatable rollers, and make contact with the inner circumferential surface of the transport belt in the width-direction end parts thereof.

8. The image forming apparatus according to claim 7, wherein the support members are provided so as to make contact with length-direction end faces of the transferring member and rotate coaxially with the transferring member.

9. The image forming apparatus according to claim 8, wherein the support members are formed of an electrically insulating material having a lower hardness than the transferring member, and have an outer diameter greater than an outer diameter of the transferring member.

10. The image forming apparatus according to claim 1, wherein when a contact width between the transport belt and the image carrying member in a length direction of the image carrying member is represented by L1, and a contact width between the transport belt and the transferring member in a length direction of the transferring member is represented by L2, then a relationship L1>L2 is fulfilled.

11. The image forming apparatus according to claim 1, wherein at least one of the driving roller and the following roller has a belt holding portion which holds the transport belt so that the transport belt is laid across this and the other roller, and truncated conical portions which are formed contiguously with both end parts of the belt holding portion and which are formed as to have an increasingly small diameter toward length-direction ends, and the truncated conical portions make contact with end parts of the transport belt so as to restrict meandering of the transport belt.

12. The image forming apparatus according to claim 11, wherein when a contact width between the transport belt and the transferring member in a length direction of the transferring member is represented by L2, and a length of the belt holding portion in a length direction thereof is represented by L3, then a relationship L3>L2 is fulfilled.

13. The image forming apparatus according to claim 1, wherein one width-direction end face of the transport belt makes contact with a meandering restricting member which is provided in a body of the apparatus.

14. The image forming apparatus according to claim 1, wherein the transport belt is arranged so as to have a concave sag toward the transferring member with respect to a tangent line that connects between intersections of the transport belt with outer circumferential parts of the driving roller and the following roller, respectively, in a direction in which the transport belt is laid.

* * * * *